United States Patent [19]

Brakel

[11] 4,253,782

[45] Mar. 3, 1981

[54] HOPPER WITH FLOATING CAPACITY

[75] Inventor: Joost Brakel, Schiedam, Netherlands

[73] Assignee: Koninklijke Volker Stevin N.V., Rotterdam, Netherlands

[21] Appl. No.: 57,101

[22] Filed: Jul. 12, 1979

[30] Foreign Application Priority Data

Jul. 14, 1978 [NL] Netherlands ..... 7807601

[51] Int. Cl.[3] ..... B65G 53/30

[52] U.S. Cl. ..... 406/38; 406/118; 406/127; 406/141; 406/151

[58] Field of Search ..... 406/38, 39, 93, 94, 406/96, 117, 118, 119, 120, 122, 123, 127–133, 141, 142, 151; 114/27

[56] References Cited

U.S. PATENT DOCUMENTS

| | | | |
|---|---|---|---|
| 368,691 | 8/1887 | See | 406/94 X |
| 418,421 | 12/1889 | Osborn | 406/38 X |
| 1,337,279 | 4/1920 | Sensibar | 406/38 |
| 1,614,859 | 1/1927 | Wilson | 406/38 |
| 3,993,359 | 11/1976 | Sweeney | 406/142 X |
| 4,176,885 | 12/1979 | Alkema | 406/128 |

*Primary Examiner*—James L. Rowland

[57] ABSTRACT

A hopper comprises a suction conduit and a pressure conduit each connected to a pump for discharge of the hopper contents, the suction conduit being horizontal and communicating at its free end via a control valve with water outside the hopper, a plurality of vertically extending suction pipes extending downwardly from the suction conduit and spaced above the hopper bottom, each suction pipe having a valve, and cone-shaped bottom valves below the suction pipe open ends for conducting water from outside the hopper to the suction pipes.

3 Claims, 3 Drawing Figures

HOPPER WITH FLOATING CAPACITY

The present invention relates to a hopper with floating capacity, said hopper being provided with a pump, a suction conduit and a pressure conduit for discharge of the contents, in which the suction conduit extends substantially in horizontal direction.

A hopper of this kind is generally known, e.g., Dutch Patent No. 155,326.

In the case of the known hopper, the suction conduit extends at a short distance above the bottom of the hopper. To stimulate the discharge of the contents of the hopper, a special water pump and a special water conduit are used, which make the cargo fluid so that the discharge of same via the suction conduit is made possible.

The method is quite efficient, e.g., when the cargo consists of sand. However, when the hopper is filled with gravel, the method proves to be unsatisfactory since, with the known hopper, it is impossible to regulate the concentration. This leads to too high fluctuations in the required pressures. A mixture flow containing gravel cannot be regulated by throttling, since this would lead to blocking up.

It is the object of this invention to improve upon the known hopper and said object is achieved in that the suction conduit is disposed above the bottom, that the free end portion of the suction conduit communicates with the water outside via a control valve, that a number of substantially vertically extending suction pipes connect to the suction conduit, the free end portions of said pipes terminating some distance above the bottom of the hopper, that valves have been disposed in the suction pipes and that means have been provided near the free end portions of the suction pipes, said means conducting the water outside to the suction pipes.

When the cargo in a compartment of a particular suction pipe is to be discharged, the valves in the other suction pipes will be closed.

When the valve in the suction conduit is throttled, the pressure in the suction conduit will drop and the liquid flow will increase via the open suction pipe and the cargo will be taken along.

The means for the supply of the water outside may comprise a water pump and a water conduit, as is the case in Dutch Patent 155,326, in which the water conduit must open near the mouth of each suction pipe.

However, when the hopper is provided with bottom valves which are used for the discharge of the contents of the hopper via the bottom, the means for the supply of water outside may be constituted by the bottom valves, said valves being disposed below the mouths of the substantially vertical suction pipes and for which purpose said valves are embodied such that in an intermediate position they allow the water to flow through from outside.

To that end, the bottom valves have been cleverly provided with an elevation, from which one segment has been omitted so that in the intermediate position the water outside may flow in through the opening thus created.

The bottom valves are closed when the hopper is being loaded and/or being moved; said valves are fully open when the hopper has to be discharged via the bottom valves. The bottom valves are successively brought into the intermediate position when the hopper has to be discharged by sucking off with the aid of the suction pump.

The invention will now be described more in detail with reference to the accompanying diagrammatic drawings;

wherein

Figure 1:
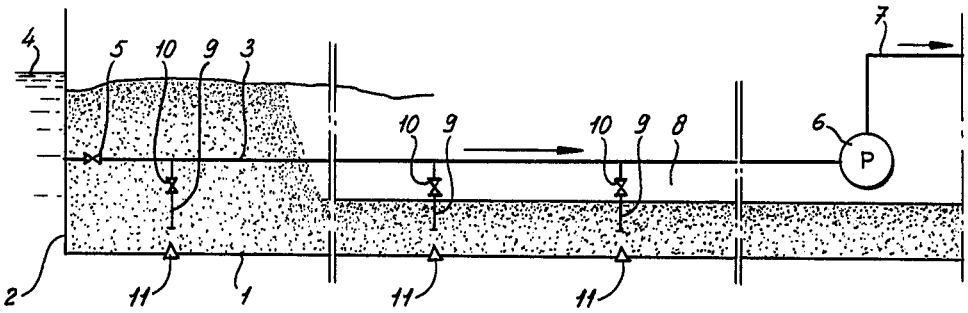
FIG. 1 is a diagrammatic view of the piping system of the hopper in accordance with the invention.
Figure 2:
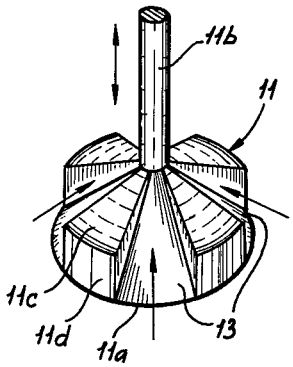
FIG. 2 is a diagrammatic perspective view of a cone-shaped bottom valve which is adapted for the hopper in accordance with the invention.

In FIG. 1 the bottom of the hopper in accordance with the invention is indicated by reference numeral 1 and a vertical wall has been indicated by reference numeral 2.

A suction conduit 3 extends parallel to the bottom 1, said conduit opening at its free end into the surrounding water via wall 2; the water level has been indicated by reference numeral 4.

A control valve 5 has been disposed in the suction conduit 3 near wall 2. The suction conduit 3 connects to the suction side of pump 6, said pump being connected to a pressure conduit 7 for discharge of the contents of the hopper.

Suction conduit 3 extends at a distance above the bottom 1, above the cargo 8 and may run horizontal to the transverse and/or longitudinal axis of the hopper.

A number of vertically extending suction pipes 9 has been connected to suction conduit 3, each suction pipe being provided with a valve 10.

The open ends of the suction pipes 9 terminate some distance above bottom 1 for admission of the cargo 8, which may consist of gravel. This distance is not very critical. A distance of, for instance, two times the pipe diameter is suitable.

The hopper according to the embodiment has been provided with cone-shaped bottom valves 11 in a known manner. The suction pipes 9 are disposed in such a way that a suction pipe 9 is positioned above each bottom valve 11.

A known bottom valve comprises a cone **11*a* with an operating spindle 11*b*. In closed position, the edge of cone 11*a* forms a seal with a cylindrical seat 12 provided in the bottom 1** of the hopper.

In order to adapt a valve of the aforementioned kind for the hopper in accordance with the invention, a second upper cone surface **11*c* has been disposed on lower cone surface 11*a*, said cone 11*c*, with its vertical cylindrical edge 11*d*, being connected to cone 11*a***.

Figure 3:
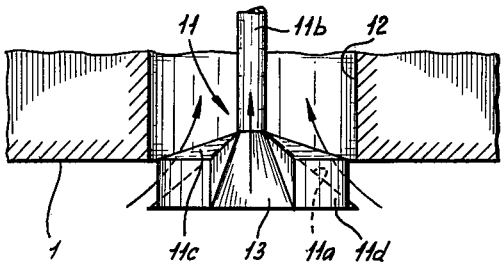
FIG. 3 illustrates the bottom valve in accordance with FIG. 2 in the intermediate position.

When one or more segments 13 are removed from the valve 11 between the upper cone and wall segments **11*c*, 11*d*, said valve will be closed in the closed position; however, in the intermediate position (illustrated in FIG. 3) said valve will allow the water to flow through from outside through the channels defined between the upper cone and wall segments 11*c*, 11*d***.

The water provides a substantially vertical flow of water and cargo in the relevant suction pipe 9 when the valve 10 has been opened and the pump 6 is in operation.

The suction system works as follows:

Valve 5 and the first valve 10 are opened and pump 6 is started. Bottom valve 11 is brought into the intermediate position. The other valves 10 are closed.

The resistance through the valve 5 is less than through the first valve 10 because the cargo has to pass therethrough.

When the valve 5 is throttled, the pressure in suction conduit 3 will drop and the flow via the first suction pipe 9 will increase. A vertical flow will now occur via the first bottom valve 11 towards the first valve 10 with which cargo material flowing in from the sides is being carried along in upward direction and is being discharged via the pressure conduit 7. The amount of material depends on the rate of flow via the valve 10.

The rate may be regulated by throttling valve 5 in a greater or lesser degree. As soon as the first compartment of the hopper is empty, the first valve 10 and the first bottom valve 11 will be closed.

Subsequently, the second valve 10 will be opened and the second bottom valve 11 will be brought into the intermediate position, and so on, until all compartments have been emptied. The hopper according to the invention is very suitable for gravel since the concentration can be regulated.

Other embodiments of this invention will occur to those skilled in the art which are within the scope of the following claims.

What is claimed is:

1. An improved hopper with floating capacity, said hopper being provided with a pump, a suction conduit connected to the suction side of said pump and a pressure conduit connected to the pressure side of said pump for discharge of the contents, in which the suction conduit extends substantially in horizontal direction to a free end remote from said pump, the suction conduit spaced above the bottom of the hopper, and the free end of the suction conduit communicating with the water from outside the hopper, a number of suction pipes connected at one end thereof to the suction conduit and extending substantially vertically downwardly therefrom to their other ends, the other ends of said pipes being open and terminating a distance above the bottom of the hopper, wherein the improvement comprises means provided below the open ends of the suction pipes for conducting the water from outside the hopper to the suction pipes and a control valve disposed in said suction conduit between its free end and said suction pipes whereby the amount of material drawn through said suction pipes by said pump is controlled by opening or throttling said control valve.

2. A hopper, said hopper being provided with a pump, a suction conduit connected to the suction side of said pump and a pressure conduit connected to the pressure side of said pump for discharge of the contents, in which the suction conduit extends substantially in horizontal direction to a free end remote from said pump, the suction conduit being spaced above the bottom of the hopper, the free end of the suction conduit communicating with the water from outside the hopper and provided with a control valve, a number of suction pipes connected at one end thereof to the suction conduit and extending substantially vertically downwardly therefrom to their other ends, the other ends of said pipes being open and terminating a distance above the bottom of the hopper, suction pipe valves disposed in each of the suction pipes, said hopper being provided with bottom valves, characterized in that the bottom valves comprise a means for conducting water into the hopper from outside the hopper, said bottom valves being disposed below the open ends of the suction pipes and said bottom valves are adapted in one position to allow the water to flow through from outside while retaining in the hopper its contents.

3. A hopper in accordance with claim 2, characterized in that each bottom valve has an upper and a lower surface and has a generally cylindrical wall therebetween, said upper surface and said cylindrical wall interrupted to form segments and defining channels therebetween so that in said one position the water outside may flow in through the channels, each bottom valve being connected in said hopper for movement between said one position and a closed position.

* * * * *